US005725306A

United States Patent [19]

Kappel et al.

[11] Patent Number: 5,725,306

[45] Date of Patent: Mar. 10, 1998

[54] HIGH EFFICIENCY MIXER FOR MIXING PULP MATERIAL AND TREATMENT SUBSTANCES

[75] Inventors: Johannes Kappel; Johann Sbaschnigg, both of Graz, Austria

[73] Assignee: Andritz-Patentverwaltungs-Gesellschaft m.b.H., Graz, Austria

[21] Appl. No.: 549,751

[22] PCT Filed: May 18, 1994

[86] PCT No.: PCT/AT94/00069

§ 371 Date: Feb. 15, 1996

§ 102(e) Date: Feb. 15, 1996

[87] PCT Pub. No.: WO94/27713

PCT Pub. Date: Dec. 8, 1994

[30] Foreign Application Priority Data

May 24, 1993 [AT] Austria ..... 1007/93

[51] Int. Cl.[6] ..... B01F 5/04; B01F 15/02

[52] U.S. Cl. ..... 366/157.1; 366/172.2; 366/304; 241/261.2

[58] Field of Search ..... 366/102–104, 366/107, 156.1, 157.1, 157.2, 168.1, 169.1, 169.2, 170.2, 171.1, 172.1, 172.2, 181.7, 303, 304, 320; 241/260.1, 261.2; 162/57, 243

[56] References Cited

U.S. PATENT DOCUMENTS

| | | | |
|---|---|---|---|
| 2,008,892 | 7/1935 | Asplund | 241/261.2 X |
| 2,139,933 | 12/1938 | Chenoweth | 241/261.2 X |
| 3,682,447 | 8/1972 | Zucker et al. | 366/157.1 |
| 4,202,505 | 5/1980 | Ruuskanen | 241/261.2 X |
| 4,220,290 | 9/1980 | Johansson | 241/261.2 X |
| 4,253,613 | 3/1981 | Reinhall | 241/261.2 X |
| 4,439,042 | 3/1984 | Bertoglio | 366/303 X |
| 4,872,617 | 10/1989 | Foresman | 241/261.2 X |
| 5,429,316 | 7/1995 | Arvidsson et al. | 241/261.2 |

FOREIGN PATENT DOCUMENTS

| | | | |
|---|---|---|---|
| 655961 | 1/1963 | Canada | 241/261.2 |

*Primary Examiner*—Charles E. Cooley

*Attorney, Agent, or Firm*—Alix, Yale & Ristas, LLP

[57] ABSTRACT

A mixer for fluffing and mixing pulp with treatment additives includes a disc rotor, an annular stator, a pulp feed channel, a ribbon feeder and a baffle, the axially rotating disc rotor including a shaft and a grinding segment. The stator includes a grinding segment which opposes the rotor grinding segment. The feed channel is coaxial with the rotor axis, has a discharge end which confronts the rotor and has an inlet end for receiving pulp. The ribbon feeder is coaxially disposed within the feed channel and has a hollow axially rotating shaft. This feeder discharges pulp at the rotor toward the mixing and fluffing zone. The baffle is carried on the feeder shaft and guides the pulp toward the fluffing and mixing zone. Treatment additives are introduced as the pulp moves toward the discharge end of the channel.

21 Claims, 2 Drawing Sheets

1
2
3
4
5
6
7
8
9
10
11
12
13
17

1
2
3
5
6
7
8
9
14
15
16
17

HIGH EFFICIENCY MIXER FOR MIXING PULP MATERIAL AND TREATMENT SUBSTANCES

BACKGROUND OF THE INVENTION

The invention refers to a mixer, particularly a high-efficiency mixer for fluffing shredded pulps and mixing them with treatment substances and/or additives, particularly bleaching chemicals. Such a mixer contains an annular mixing and fluffing zone, located between a disc rotor and an annular stator, and a central material feed channel in which a positive conveyor is located for conveying purposes.

Mixers are described in, for example, AT-PS 388 193 and show a material feed channel in the form of a vertical chute, where the annular mixing and fluffing zone is located accordingly on a horizontal plane and the treated material is carried off to the side. The throughput of these mixers is limited because the diameter: of the chute cannot be selected at will.

Also described in CH-PS 485 479 is a device for creating dispersions or solutions from a liquid component and a solid or pasty component using a mixing apparatus. To achieve this the solid or pasty component is fed to the mixing apparatus through a conveying screw which ends directly in front or the rotor of the mixing apparatus and the liquid component is discharged from a feed pipe at the end of the conveying screw. If this configuration is used to mix fibrous pulps with treatment substances, e.g. bleaching chemicals, the result would be Inadequate conveying, on the one hand, since the material does not fill the conveying screw, and on the other hand uneven penetration of the fibrous pulps on the other hand.

SUMMARY OF THE INVENTION

The invention, the positive conveyor is configured as a ribbon feeder. In one embodiment, a baffle, in particular a baffle shaped like the envelope of a cone, that is firmly connected to the shaft of the ribbon feeder, with associated treatment discharge holes, at the end of the shaft of the ribbon feeder. Alternatively, a double casing defining a treatment fluid flow path is provided round the ribbon feeder. Thus, the ring of fibrous pulp forming around the circumference of the pulp feed channel can be guided particularly well, and any treatment substances, particularly bleaching chemicals, in liquid or gaseous form, are evenly distributed in the vicinity of the mixing and fluffing zone.

This design also permits the possibility of a plant with a horizontal material feed channel and appropriate vertical arrangement or the mixing and fluffing zone in which the rotor and stator are mounted at right angles to the horizontal. A slanting arrangement is thus also possible.

In those mixer designs already known, additives, particularly bleaching chemicals, are dosed into the chute, for example, where problems can occur with even distribution of the additives through the material, particularly if liquid additives are used. In the case of pulp, it is well known that its high capacity for adsorption makes liquid additives difficult to distribute if the pulp is not saturated. In addition, there is also the problem of non-uniform retention time and uneven reaction process since the aim is that the additives (only) take their full effect in the mixing and fluffing zone sector.

Positioning a positive conveyor in the feed channel according to this invention, opens up the possibility of feeding the treatment substances and/or the additives centrally through the positive conveyor itself. Thus the invention includes the feature that a positive conveyor is provided for feeding of treatment substances and/or additives by means of an axial hollow shaft through which the treatment substances and/or additives can be dosed.

In this case, for example, the hollow shaft of the positive conveyor can contain outlets along its entire length or in selected sections thereof, preferably, at the end facing the mixing and fluffing device, i.e., as near as possible to the disc rotor.

The hollow shaft can serve to feed in various additives, e.g., to feed in gas over the entire length of the shaft and/or to feed in liquid at the end of the shaft, whereby at least one separate pipe can be included in the shaft for feeding in treatment substances and/or additives. Such a pipe is easy to change and can be removed for cleaning. This cleaning capability is important if, for example, silicate is added in a peroxide bleaching process.

In order to achieve good distribution of the additives introduced at the end of the positive conveyor before they come into contact with the material and to establish such contact as close to the mixing and fluffing zone as possible, a baffle, particularly a baffle shaped like the envelope of a cone can be mounted at the end of the positive conveyor next to the mixing and fluffing zone. This baffle should deflect the solids towards the periphery of the material feed channel, with at least one opening being provided, particularly on the side of the baffle facing the mixing and fluffing zone.

Furthermore, the invention includes for this purpose that said at least one opening has a discharge direction which runs at least generally parallel to the side of the baffle. Thus, the treatment substances and/or additives are guided towards the mixing and fluffing zone. A further possible configuration of the mixer is to place the positive conveyor in a feed channel with a double casing and use the interspace between the two walls of the casing to feed gases and/or vapors to the mixing and fluffing zone.

In this case the double casing can include a deflector rim at the end nearest the mixing and fluffing zone which deflects gases and/or vapors towards the mixing and fluffing zone. The interspace can also have an extension at the end facing the mixing and fluffing zone.

With the mixer according to the invention it is possible to obtain optimum distribution of the treatment substances and/or additives in the pulp, as well as to achieve contact as close as possible to the mixing and fluffing zone. The positive conveyor can be cleaned easily.

The mixer according to the invention is intended particularly for treatment of fibrous material. By way of example, the starting material, e.g. groundwood, TMP or CTMP, is pre-dewatered on a wire belt press, usually a double wire belt press, shredded in a shredder and then fed to the mixer inlet by a conveyor screw. After going through the mixer, the pulp is transported to a bleaching tower and is removed from there as bleached pulp.

With the mixer according to the invention a shredded pulp web is broken down into single fibres to a large extent. Due to the large fibre surface the bleaching agent, which can be applied either as a solution or in gaseous form, e.g. ozone, penetrates the fibres quickly and evenly. The mixing process does not cause any change in the fibre fraction. By adding the chemicals immediately before the rotor, the chemicals do not take effect on the fibres until this point, where they are present as more or less single fibres, thus considerably enhancing the efficiency of the bleaching process. As a result, the retention time of the pulp can be reduced both in the mixer and in the bleaching tower, thus making a higher throughput possible.

BRIEF DESCRIPTION OF THE DRAWINGS

The invention is explained in more detail using two different designs of a mixer according to the invention, with reference to the accompanying drawing in which the same components have the same reference markings and in which.

DESCRIPTION OF THE PREFERRED EMBODIMENT

Figure 1:
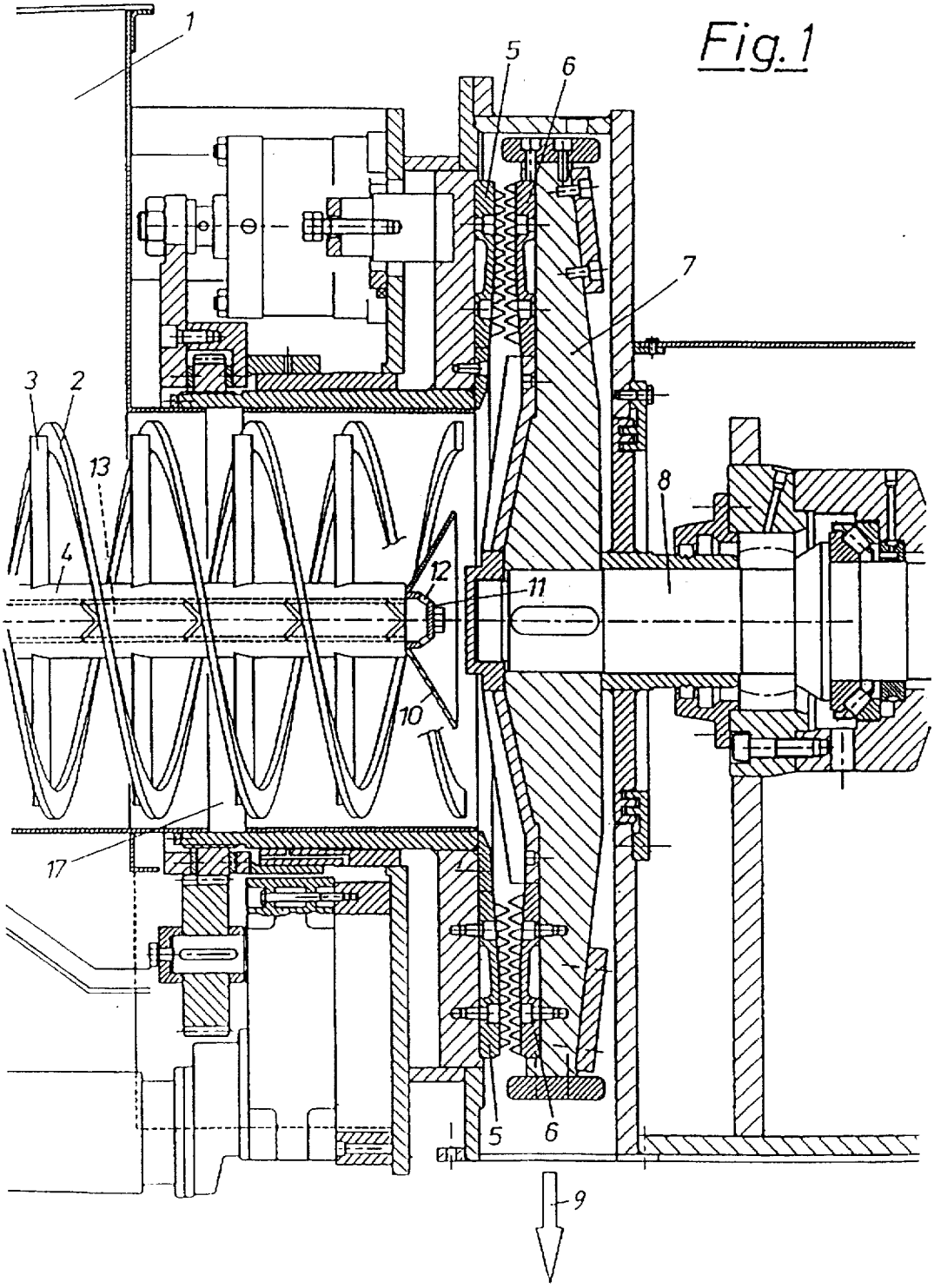
FIG. 1 shows a section of a mixer with chemical feed through the hollow shaft of the positive conveyor and FIG. 2 shows a section of a mixer with chemical feed via the double casing of the pulp feed channel.

FIG. 1 shows a longitudinal section through a mixer according to the invention in which the pulp to be fluffed and bleached is fed in through inlet 1 and positively conveyed to the pulp feed channel 17 by a ribbon feeder 2. The screw flights of the ribbon feeder 2 are attached to a hollow shaft 4 by struts 3. The pulp is fed to the rotor 7 centrally by the ribbon feeder 2 and brought in between the grinding segments 5 on the stator side and the grinding segments 6 on the rotor side. Due to the rotating movement by the rotor shaft 8 the pulp fibres are mixed and fluffed between the segments 5, 6 and permit the bleaching chemicals added to penetrate the pulp completely and thus, to bleach it fully. The pulp is then discharged again at 9 and fed to a further treatment stage or the bleaching reaction is completed in a subsequent bleaching tower.

The bleaching agent is added to the rotor 7 through the hollow shaft 4 of the ribbon feeder 2. Peroxide, for example, is fed through the inner chamber 13 of the hollow shaft 4 to a discharge fitting 11 which closes off the end of the hollow shaft 4 and contains openings, preferably drill holes 12. This discharge fitting 11 is mounted in the conveying direction behind a baffle 10 shaped like the envelope of a cone. The conic frustum opens here pointing in the direction of the rotor 7. Due to the rotating movement of the hollow shaft 4 the bleaching chemicals are guided by the centrifugal force towards the inner side of the baffle 10, which is assisted by the orientation of the axes of the drill holes 12 in the direction of the generatrix of the conical envelope. At the end of the baffle 10 facing the rotor 7 the chemicals are then distributed evenly over the circumference and thus brought close to the mixing and fluffing zone between the segments 5 and 6.

Figure 2:
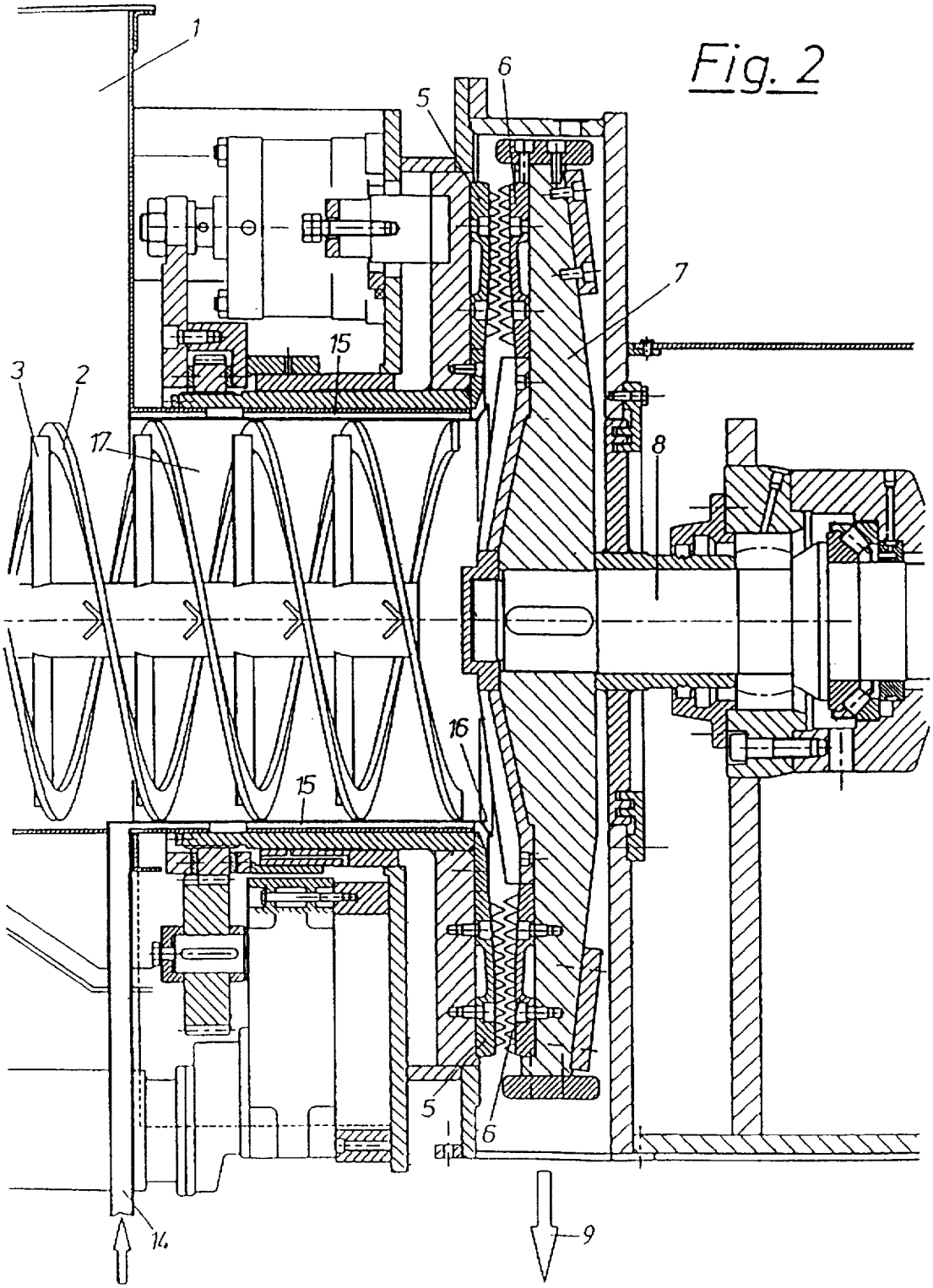

FIG. 2 illustrates a variant for gaseous bleaching chemicals in which the chemicals, e.g. ozone, are fed through a feed pipe 14 to a ring slot 15 formed by a double casing of the material feed channel 17. At the channel end facing the rotor 7 the channel has a widening and/or a deflection rim 16 enabling the chemicals to be brought in with as even a distribution as possible and close to the mixing and fluffing zone 5, 6.

The invention is not limited to the designs illustrated, with other designs of distribution device, in particular, being conceivable, and the characteristic features shown in FIGS. 1 and 2 can also be realised in combination.

We claim:

1. High-efficiency mixer for fluffing and mixing shredded pulp with treatment additives, having an annular mixing and fluffing zone formed between a disc rotor fixed to a rotor shaft extending along a rotation axis and an annular stator, and having an axially extending central pulp feed channel with a positive conveyor in the channel to convey the shredded pulp to the mixing and fluffing zone, wherein the improvement comprises:

the positive conveyor being a ribbon feeder (2, 3, 4) fixed to a hollow axially extending rotatable feeder shaft, a baffle (10) shaped like the envelope of a cone, which is firmly connected to the shaft of the ribbon feeder, provided at the end of the ribbon feeder next to the mixing and fluffing zone, to feed the additives and to deflect the pulp emerging from the ribbon feeder to the periphery of the feed channel (17).

treatment means for delivering additives through the feeder shaft, the feeder shaft having at least one opening (12) at the end of the shaft facing the mixing and fluffing zone in order to discharge additive into the feed pulp immediately before the rotor.

2. High-efficiency mixer according to claim 1, wherein the hollow shaft contains at least one separate pipe (13) to supply the treatment additives.

3. High-efficiency mixer according to claim 2, wherein said at least one opening (12) is provided at the interior of the baffle (10) facing the mixing and fluffing zone.

4. High-efficiency mixer according to claim 3, wherein said at least one opening (12) has a discharge direction which runs at least generally parallel to the baffle (10).

5. High-efficiency mixer according to claim 2, wherein the pulp feed channel is a horizontal material feed channel and the ribbon feeder is provided in the horizontal material feed channel.

6. High-efficiency mixer according to claim 1, wherein said at least one opening (12) is provided at the interior of the baffle (10) facing the mixing and fluffing zone.

7. High-efficiency mixer according to claim 6, wherein said at least one opening (12) has a discharge direction which runs at least generally parallel to the baffle (10).

8. High-efficiency mixer according to claim 6, wherein the pulp feed channel is a horizontal material feed channel and the ribbon feeder is provided in the horizontal material feed channel.

9. High-efficiency mixer according to claim 1, wherein the pulp feed channel is a horizontal material feed channel and the ribbon feeder (12) is provided in the horizontal material feed channel.

10. High-efficiency mixer for fluffing and mixing shredded pulp with treatment additives, having an annular mixing and fluffing zone formed between a disc rotor fixed to a rotor shaft extending along a rotation axis and an annular stator, and having an axially extending central pulp feed channel, with a positive conveyor in the channel to convey the shredded pulp to the mixing and fluffing zone, wherein the improvement comprises the positive conveyor being a ribbon feeder and the feed channel (17) being located within a double walled casing, where an interspace (15) between the two walls of the casing defines a flow path for delivery of the treatment additive toward the mixing and fluffing zone and which discharges immediately in front of the rotor.

11. High-efficiency mixer according to claim 10, wherein the double walled casing has a deflective rim (16) at the end nearest to the mixing and fluffing zone which deflects the additive towards the mixing and fluffing zone.

12. High-efficiency mixer according to claim 10, wherein the feed channel is a horizontal material feed channel and the ribbon feeder is provided in the horizontal material feed channel.

13. A mixer for fluffing and mixing pulp with treatment additives, comprising:

a disc rotor affixed to a main shaft, for rotation about a longitudinal axis, and having an annular grinding segment carried thereon;

an annular stator defining a grinding segment opposed to the grinding segment carried on the rotor, thereby defining a mixing and fluffing zone therebetween;

wall means defining a pulp feed channel extending coaxially along the longitudinal axis, having a discharge end confronting the rotor and an inlet end for receiving a supply of pulp;

a ribbon feeder supported coaxially within the feed channel and being fixed to a hollow rotatable feeder shaft coaxial with the feed channel whereby pulp is discharged from the ribbon feeder at the rotor toward the mixing and fluffing zone;

baffle means for guiding the conveyed pulp at the discharge end of the channel toward the mixing and fluffing zone, the baffle means being carried on and rotatable with the feeder shaft; and means for introducing said treatment additive to the pulp, as the pulp is discharged toward said zone.

14. The mixer of claim 13, wherein the baffle means are situated at the discharge end of the channel.

15. The mixer of claim 13, wherein the baffle means has the shape of a hollow cone which diverges toward the rotor.

16. The mixer of claim 15, wherein the means for introducing the treatment additive comprises an axial flow path through the feeder shaft and discharge opening at the baffle means.

17. The mixer of claim 16, wherein the cone defines an inner side facing the rotor and an outer side facing said wall means, and the discharge openings are situated between the inner side of the cone and the rotor.

18. The mixer of claim 17, wherein the discharge openings define a discharge direction which is substantially parallel to the inner side of the cone.

19. The mixer of claim 13, wherein the means for introducing the treatment additive comprises an axial flow path through the feeder shaft and discharge openings at the baffle means.

20. A mixer for fluffing and mixing pulp with treatment additives, comprising:

a disc rotor affixed to a main shaft, for rotation about a longitudinal axis, and having an annular grinding segment carried thereon;

an annular stator defining a grinding segment opposed to the grinding segment carried on the rotor, thereby defining a mixing and fluffing zone therebetween;

wall means defining a pulp feed channel extending coaxially along the longitudinal axis, having a discharge end confronting the rotor and an inlet end for receiving a supply of pulp;

a ribbon feeder supported coaxially within the feed channel and having a rotatable shaft coaxial with the feed channel whereby pulp is discharged from the ribbon feeder at the rotor toward the mixing and fluffing zone; and means for introducing said treatment additive to the pulp, as the pulp is discharged toward said zone;

wherein the wall means is double walled, thereby defining an interspace which extends to a circular fluid discharge opening at the discharge end of the channel, thereby forming the means for introducing the treatment additive.

21. The mixer of claim 20, wherein baffle means are formed as a stationary deflection rim and a discharge opening at the discharge end of the channel, and wherein the baffle means guides the conveyed pulp toward the mixing and fluffing zone.

* * * * *